US005649855A

United States Patent [19]

Chikaki

[11] Patent Number: 5,649,855

[45] Date of Patent: Jul. 22, 1997

[54] WAFER POLISHING DEVICE

[75] Inventor: Shinichi Chikaki, Tokyo, Japan

[73] Assignee: NEC Corporation, Japan

[21] Appl. No.: 590,122

[22] Filed: Jan. 23, 1996

[30] Foreign Application Priority Data

Jan. 25, 1995 [JP] Japan ..... 7-009843

[51] Int. Cl.[6] ..... B24B 5/00

[52] U.S. Cl. ..... 451/290; 451/285

[58] Field of Search ..... 451/285, 286, 451/287, 288, 289, 290, 291, 41, 42, 499, 504

[56] References Cited

U.S. PATENT DOCUMENTS

| | | | |
|---|---|---|---|
| 2,618,911 | 11/1952 | Indge | 451/287 |
| 2,979,868 | 4/1961 | Emeis | 451/291 |
| 3,110,988 | 11/1963 | Boettcher | 451/286 |
| 3,504,457 | 4/1970 | Jacobsen et al. | 451/288 |
| 3,615,955 | 10/1971 | Regh et al. | 451/288 |
| 3,708,921 | 1/1973 | Cronkhite et al. | 451/285 |
| 3,897,657 | 8/1975 | Smith | 451/42 |
| 4,165,584 | 8/1979 | Scherrer | 451/289 |
| 4,458,454 | 7/1984 | Barnett | 451/42 |
| 4,606,151 | 8/1986 | Heynacher | 451/42 |
| 5,423,716 | 6/1995 | Strasbaugh | 451/289 |

*Primary Examiner*—James G. Smith
*Assistant Examiner*—Derris H. Banks
*Attorney, Agent, or Firm*—Hayes, Soloway, Hennessey, Grossman & Hage, P.C.

[57] ABSTRACT

In a wafer polishing device, a resin sheet polishes a wafer with a polishing liquid fed thereto, while sliding on the wafer. Tension mechanisms apply an adequate degree of tension to the sheet in order to provide it with a desired elastic strength. Even if the wafer has a deformation or roughness ascribable to its uneven thickness, the sheet corrects some degree of deformation and then polishes the wafer, following the corrected configuration of the wafer. At this instant, the pressure acting on the wafer is even over the entire surface of the wafer. The sheet is formed of a material which is hydrophilic and resistant to fluoric acid. With this construction, the device corrects irregularities ascribable to the formation of a device from the wafer even if the wafer itself has any deformation or irregularity.

9 Claims, 2 Drawing Sheets

WAFER POLISHING DEVICE

BACKGROUND OF THE INVENTION

The present invention relates to a device for polishing the surface of a wafer which is roughened due to repeated film forming and etching.

On an LSI (Large Scale Integrated circuit) production line, the surface of a wafer or semiconductor substrate is repeatedly subjected to photolithographic patterning for forming a device. The repeated patterning produces fine irregularities corresponding to the device configuration on the wafer surface. This is particularly true when the designed device size is 1 μm or less. Because the irregular wafer surface makes it difficult to form a wiring layer thereon, it must be flattened. It has been customary to use a wafer polishing device for polishing the wafer surface chemically and mechanically. The conventional polishing device has a rotary holder for holding the rear of the wafer. A turn table faces the holder and has a polishing pad for polishing the front of the wafer held by the holder. A polishing liquid is fed from a nozzle to the pad. A pressing mechanism presses the wafer against the pad via the holder.

However, the conventional polishing device with the above construction has the following problems (1)–(4) left unsolved.

(1) The wafer surface cannot be flattened beyond a certain limit. Why the wafer surface can be flattened by polishing is that the pad contacts the convex portion of the surface with a pressure higher than the pressure with which it contacts the concave portion of the same, thereby polishing the convex portion at a higher rate than the concave portion. In addition, in the convex portion, a broad pattern is difficult to polish. Hence, the wafer surface will become more flat when the pad is implemented by a material having higher rigidity. However, when the pad is formed of an urethane resin or similar material whose rigidity is low, the flattening degree is limited depending on the width of irregularity, and is about 0.5 mm at the present stage of development. On the other hand, in parallel with the progress of fine and large scale LSI technologies, some products recently developed require further enhancement of the flatness of the wafer surface. Particularly, a 64-bit microprocessor or similar large scale circuit results in irregularities as wide as several millimeters and above. It is difficult to flatten such a broad irregularity with the conventional polishing device. While the design of LSI patterns may be so restricted as to obviate broad irregularities, this kind of scheme complicates the design and thereby increases the designing cost and time.

(2) In the case of a wafer of the kind easy to deform itself, i.e., warp or give at its center, it is difficult to remove the irregularities resulting from the formation of a device. The deformation particular to this kind of wafer is ten times to a thousand times as great as the irregularities ascribable to the formation of a device. Therefore, it is likely that a device formed on the convex portion of the wafer is shaved off. The pad may have its elasticity or rigidity lowered to some degree in order to follow the inherent deformation of the wafer, as proposed in the past. However, a decrease in the rigidity of the pad directly translates into an increase in the softness of the pad, and therefore in the polishing ability for removing the irregularities of a device. In any case, the polishing ability cannot be enhanced unless both the elastic strength or rigidity and the softness of the pad which are contradictory to each other are satisfied. However, because the wafer is deformable in various manners, preparing numerous kinds of pads each having a particular rigidity in order to cover all kinds of deformations is not practical when it comes to the actual production line. Particularly, it is impossible to flatten a wafer having irregularities due to its uneven thickness although its deformation is small.

(3) The polishing device consumes a great amount of polishing liquid. The wafer is often scratched unless a polishing liquid constantly fills the gap between the wafer and the pad. In light of this, the pad is provided with a porous structure having bubbles on the surface and in the inside, so that the liquid can easily penetrate into infiltrate into the pad. This makes it difficult for the pad to retain the liquid. As a result, more than a necessary amount of liquid must be fed during the course of polishing, increasing the cost. In addition, the excessive amount of liquid softens the pad and thereby aggravates the above problem regarding the elastic strength of the pad.

(4) The polishing ability available with the conventional device cannot remain stable over a long period of time. When the device polishes the wafer, polishing particles come off the pad and the waste of the wafer deposit to the surface of the pad. This degrades the polishing ability and thereby prevents an even polished surface from being achieved. For this reason, it is necessary to dress the polishing surface of the pad during the interval between consecutive polishing operations. However, the dressing shaves off not only the deposits but also the pad itself, and reduces the thickness of the pad. Consequently, the polishing ability and service life of the pad are reduced. In addition, if the dressing is not even, it is difficult for the pad to flatten the wafer surface to be polished.

SUMMARY OF THE INVENTION

It is therefore an object of the present invention to provide a wafer polishing device capable of flattening the irregular surface of a waver ascribable to device formation despite deformations and irregularities inherent in the wafer.

It is another object of the present invention to provide a wafer polishing device operable with a stable polishing ability over a long period of time while consuming a minimum amount of polishing liquid.

In accordance with the present invention, a device for polishing a wafer which is a semiconductor substrate has a rotary holder for holding the rear of the wafer. A turn table includes a sheet-like polishing member for polishing the front of the wafer held by the holder. A conduit feeds a polishing liquid to the polishing member. A pressing mechanism presses the wafer against the polishing member via the holder. A tension mechanism applies a tension to the polishing member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
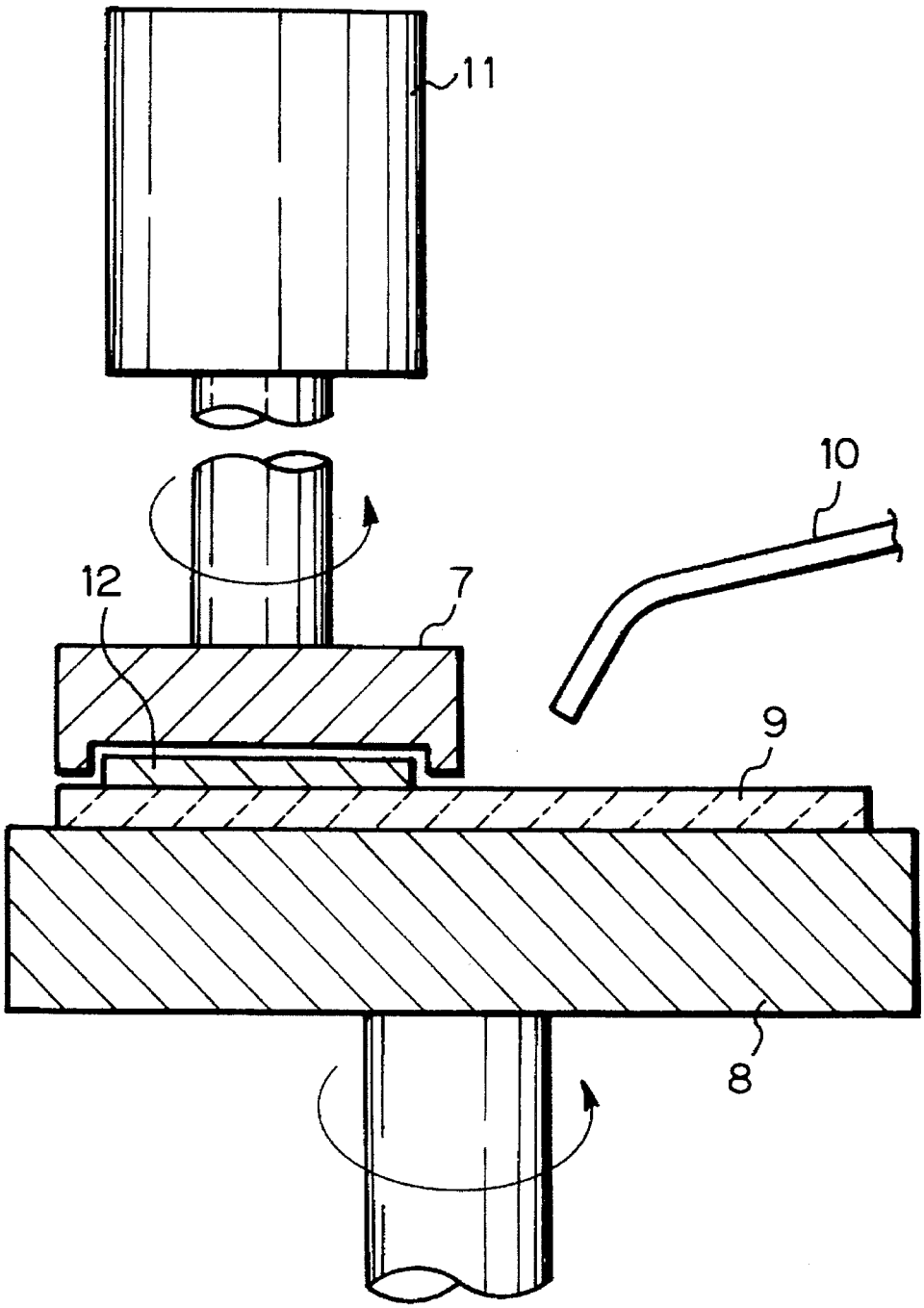
Fig. 1 PRIOR ART
FIG. 1 is a fragmentary section showing a conventional wafer polishing device.

To better understand the present invention, a brief reference will be made to a conventional wafer polishing device, shown in FIG. 1. As shown, the device has a rotary holder 7 for holding the rear of a wafer 12. A turn table 8 faces the holder 7 and has a polishing pad 9 for polishing the front of the wafer 12 held by the holder 7. A polishing liquid is fed from a nozzle 10 to the pad 9. A pressing mechanism 11 presses the wafer 12 against the pad 9 via the holder 7. The pad 9 is implemented by unwoven cloth of, e.g., foam urethane resin or polyester resin and impregnated with urethane. The cloth has an elastic strength of about 1E9 to 1E10 dyn/cm$^2$ in terms of Young's modulus, and a thickness of about 1 mm. The polishing liquid to be used depends on the material to be polished. Usually, on an LSI production line, polishing is intended mainly for a silicon oxide film which is an insulating film intervening between adjoining layers. In such a case, use is made of a mixture of silica particles and water or aqueous ammonia as the polishing liquid.

In operation, the wafer 12 is mounted to the holder 7, and then the holder 7 and turn table 8 are rotated in the same direction as each other at a speed of 10 to 100 revolutions per minute. In this condition, the mechanism 11 exerts a load of 100 to 1,000 gf/cm$^2$ on the wafer 12 via the holder 7. The polishing liquid is fed from the nozzle 10 to the pad 9 at a rate of 100 cc/min in order to polish the wafer 12.

The above polishing device has the problems (1) through (4) discussed earlier.

Figure 2A:
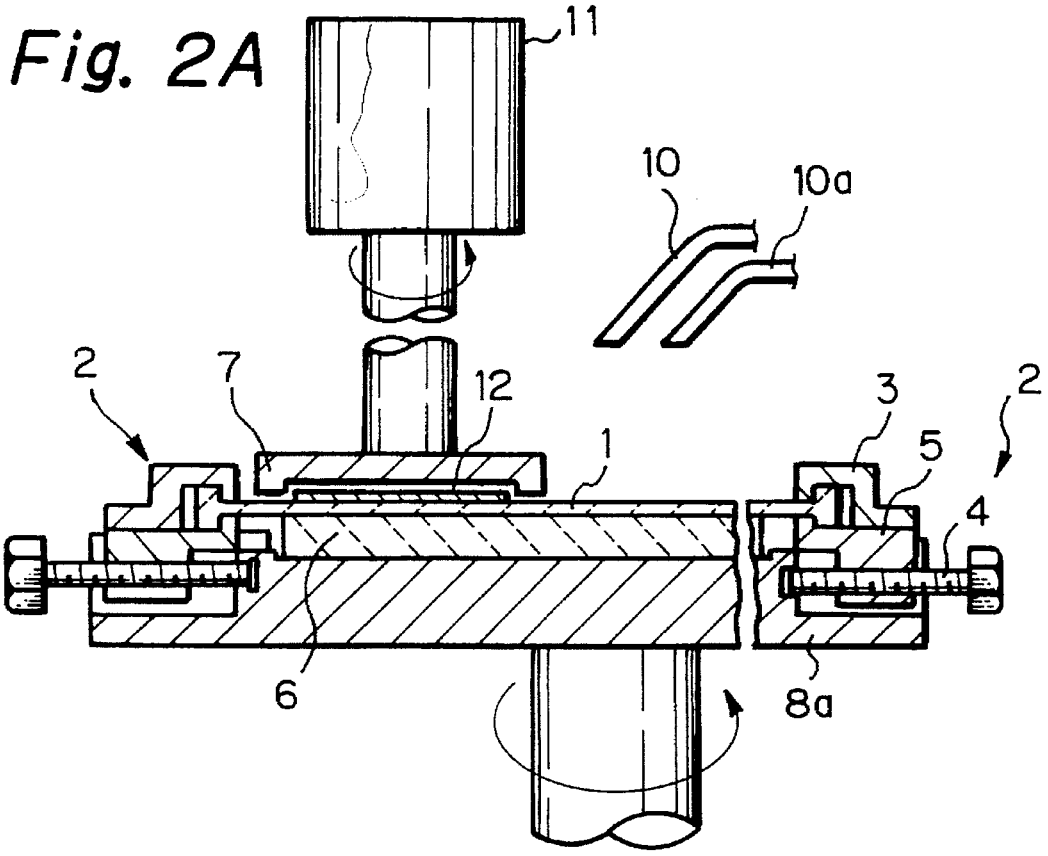
FIGS. 2A and 2B are respectively a fragmentary section and a fragmentary plan view showing a wafer polishing device embodying the present invention.
Figure 2B:
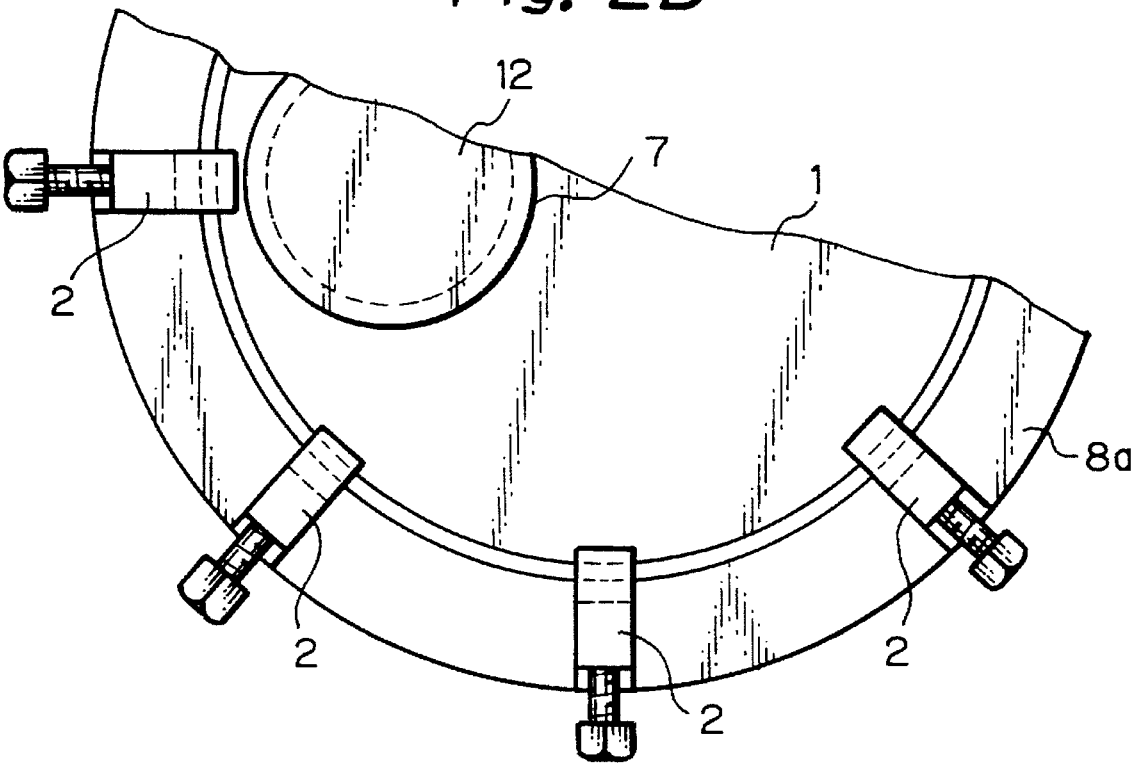

Referring to FIGS. 2A and 2B, a wafer polishing device embodying the present invention is shown. In FIGS. 2A and 2B, the same or similar constituents as or to the constituents shown in FIG. 1 are designated by the same reference numerals. As shown, the device has a sheet 1 formed of a resin resistant to hydrofluoric acid. The sheet 1 plays the role of a polishing pad against which a wafer 12 is pressed by a pressing mechanism II via a rotary holder 7. A plurality of tension mechanisms 2 apply a tension to the sheet 1. Hydrofluoric acid is fed to the sheet 1 from a cleaning liquid nozzle 10*a*. An elastic member 6 intervenes between the sheet 1 and a turn table 8*a*. The rest of the construction is identical with the conventional device shown in FIG. 1.

The tension mechanisms 2 are mounted on the peripheral face of the turn table 8*a* and positioned at equally spaced locations along the circumference of the table 8*a*. The mechanisms 2 each has a feed screw turnably fitted on the table 8*a*. A movable block 5 is formed with a female screwthread and held in mesh with the screw 4. The block 5 is slidable in a slot formed in the table 8*a*. A retainer 3 is mounted on the piece 5 and retains the circumferential edge of the sheet 1. With this configuration, the mechanisms 2 hold the circumferential edge of the sheet 1 and thereby applies a tension to the sheet 1. Of course, the tension is adjustable by turning the feed screws 4.

By adjusting the tension acting on the sheet 1 as mentioned above, it is possible to adjust the tension acting on the sheet or polishing pad 1. In addition, the tension acting on the sheet 1 cooperate with the pressure of the mechanism 11 to correct the deformation of the wafer 12. However, if the deformation is corrected to such a degree that the wafer 12 becomes fully flattened, it is likely that the portions of the wafer 12 subjected to the highest degree of correction are excessively polished due to an increase in the pressure of the sheet 1. In light of this, the degree of correction is selected such that the difference in pressure between the various portions of the sheet 1 does not exceed, e.g., 10%.

For example, assume that the wafer 12 has a diameter of 150 mm and has a 3 mm deep concavity or deformation as measured at its center. Then, if the tension derived from the tension mechanisms 2 and the pressure of the mechanism 11 are so adjusted as to reduce the concavity to about 1 mm, the difference between the pressure acting on the central part of the wafer 12 and the pressure acting on the peripheral part of the same is only about several percent. In this condition, the surface of the wafer 12 can be evenly polished by the sheet 1. Further, assume that the concavity is only 1 mm deep or less as measured at the center. Then, the wafer 12 can be evenly polished if the tension applied to the sheet 1 by the mechanisms 2 is increased.

When the wafer 12 has roughness due to its uneven thickness although free from a noticeable deformation (problem (2)), an adequate degree of tension is applied to the sheet 1 to provide it with a desired tension. In this case, the tension is selected to simply cause the sheet 1 to stretch tight. In this condition, the sheet 1 is caused to slide on the surface of the wafer 12 without correcting even the slightest deformation. As a result, the wafer 12 is evenly polished by the elastic strength particular to the sheet 1. It follows that only the irregularity of the wafer 12 ascribable to the formation of a device is removed.

The sheet 1 requirements of high tensile strength and rigidity as stated above may advantageously be implemented by a polyimide resin or a fluoric resin, e.g., tetrafluoroethylene resin or trifluoroethylene resin. Although a fluoric resin is relatively low in tensile strength, it is resistant to, e.g., fluoric acid, as will be described specifically later. Particularly, a polyimide resin is desirable. When the sheet 1 is implemented by a polyimide resin, it achieves a tensile strength of 20 kgf/mm$^2$ comparable with the tensile strength of steel if filled with glass fibers.

Although the elastic member 6 is not essential, it plays an auxiliary role when the sheet 1 follows the deformation of the wafer 12. Specifically, when the deformation of the wafer 12 originally has a concavity of 0.5 mm deep or less as measured at its center, a slight tension is applied to the sheet 1 in order to cause it and the member 6 to contact each other evenly over their entire surfaces. In this condition, the sheet 1 polishes the wafer 12 while correcting the concavity in cooperation of the member 6. The member 6 should preferably have an elastic strength equal to or smaller than that of the sheet 1 held in its unstressed state. The member 6 may advantageously be formed of acid resistant rubber, e.g., perfluoro rubber.

The polishing device having the above construction is operated as follows. First, the operator checks the wafer 12 to see if it has any deformation or irregularity, and then adjusts all the tension mechanisms 2 such that a tension matching the original configuration of the wafer 12 acts on the sheet 1. At the same time, the operator sets the pressure to be exerted by the pressing mechanism 11. Subsequently, after the wafer 12 has been mounted to the holder 7, it is pressed against the sheet 1. Then, the holder 7 and turn table 8*a* are rotated to polish the wafer 12 with a polishing liquid being fed from a polishing liquid nozzle 10.

After the polishing, the holder 7 is moved away from the turn table 8*a*, and then an aqueous solution containing hydrogen fluoride is fed onto the sheet 1 from the cleaning liquid nozzle 10*a*. As a result, silicon waste come off the wafer 12 and glass polishing particles contained in the polishing liquid are washed away from the sheet 1. This is why the sheet 1 is formed of a material resistant to fluoric acid, as stated earlier. When fluoric acid is fed to the sheet 1 every time the polishing ends, the sheet 1 has its texture prevented from being stopped up and can polish the wafer 12 with the particles of the liquid at all times. This makes it unnecessary to remove the polishing particles and silicon waste by dressing the surface of a polishing pad, as has been customary, and insures a stable polishing ability.

The sheet 1 formed of the above material is hydrophilic. Hence, the polishing liquid stays on the sheet 1 without being repulsed thereby. Experiments showed that for given conditions and a given wafer, the sheet 1 saves substantially half of the polishing liquid heretofore consumed by a porous polishing pad.

In summary, it will be seen that the present invention provides a wafer polishing device having various unprecedented advantages, as enumerated below.

(1) A polishing member polishes a wafer with a polishing liquid fed thereto, while sliding on the wafer. The polishing member is implemented as a sheet of resin. Tension mechanisms provide the polishing member with a desired elastic strength by subjecting it to an adequate tension. Even when the wafer originally has a deformation or roughness ascribable to its uneven thickness, some degree of deformation is corrected, and then the wafer and sheet slide on each other. As a result, the sheet polishes the wafer under a uniform pressure distribution, thereby removing irregularities ascribable to the formation of a device.

(2) The sheet is formed of a material resistant to fluoric acid. Hence, fluoric acid can be fed onto the sheet so as to melt silicon waste and glass polishing particles remaining on the sheet. This prevents the sheet from being stopped up and thereby insures a stable polishing ability at all times.

(3) The sheet is formed of a hydrophilic material which does not repulse water. Hence, a polishing liquid stays on the surface of the sheet without infiltrating into the sheet, so that the consumption of the liquid is reduced.

Various modifications will become possible for those skilled in the art after receiving the teachings of the present disclosure without departing from the scope thereof.

What is claimed is:

1. A device for polishing a semiconductor substrate wafer, comprising:

a rotary holder for holding a rear of the wafer;

a turn table including a resin film polishing member for polishing a front of the wafer held by said holder;

a conduit for feeding a polishing liquid to said polishing member;

a pressing mechanism acting on said holder for pressing the wafer against said polishing member;

a tension mechanism for applying tension to said polishing member; and an elastic member on a rear of said polishing member.

2. A device as claimed in claim 1, wherein said resin film polishing member comprises a sheet formed of a material which is resistive to fluoric acid.

3. A device as claimed in claim 1, wherein said resin film polishing member comprises a polyimide resin sheet.

4. A device as claimed in claim 1, wherein said tension mechanism comprises a plurality of retaining members for retaining a circumferential edge of said polishing member, and a screw feed mechanism for moving said plurality of retaining members outwardly independently of one another to apply tension to said resin film polishing member.

5. A device for polishing a semiconductor substrate wafer, comprising:

a rotary holder for holding a rear of the wafer;

a turn table including a tensioned sheet polishing member comprising a sheet formed of a material which is resistive to fluoric acid for polishing a front of the wafer held by said holder;

a conduit for feeding a polishing liquid to said polishing member;

a pressing mechanism acting on said holder for pressing the wafer against said polishing member; and a tension mechanism for applying tension to said polishing member whereby to stretch said polishing member flat and tight.

6. A device for polishing a semiconductor substrate wafer, comprising:

a rotary holder for holding a rear of the wafer;

a turn table including a tensioned sheet polishing member comprising a polyimide resin sheet for polishing a front of the wafer held by said holder;

a conduit for feeding a polishing liquid to said polishing member;

a pressing mechanism acting on said holder for pressing the wafer against said polishing member; and a tension mechanism for applying tension to said polishing member whereby to stretch said polishing member flat and tight.

7. A device for polishing a semiconductor substrate wafer, comprising:

a rotary holder for holding a rear of the wafer;

a turn table including a tensioned sheet polishing member for polishing a front of the wafer held by said holder;

a conduit for feeding a polishing liquid to said polishing member;

a pressing mechanism acting on said holder for pressing the wafer against said polishing member; and a tension mechanism for applying tension to said polishing member whereby to stretch said polishing member flat and tight, wherein said tension mechanism comprises a plurality of retaining members retaining a circumferential edge of said polishing member, and a screw feed mechanism for causing said plurality of retaining members to move outward independently of each other to thereby apply the tension to said polishing member.

8. A device as claimed in claim 7, wherein said tensioned sheet polishing member comprises a sheet formed of a material which is resistive to fluoric acid.

9. A device as claimed in claim 7, wherein said tensioned sheet polishing member comprises polyimide resin sheet.

* * * * *